US007346499B2

(12) United States Patent
Chennoukh et al.

(10) Patent No.: US 7,346,499 B2
(45) Date of Patent: Mar. 18, 2008

(54) WIDEBAND EXTENSION OF TELEPHONE SPEECH FOR HIGHER PERCEPTUAL QUALITY

(75) Inventors: Samir Chennoukh, Eindhoven (NL); Andreas Johannes Gerrits, Eindhoven (NL); Robert Johannes Sluijter, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 928 days.

(21) Appl. No.: 10/169,497

(22) PCT Filed: Nov. 9, 2001

(86) PCT No.: PCT/EP01/13137

§ 371 (c)(1),
(2), (4) Date: Jul. 3, 2002

(87) PCT Pub. No.: WO02/39430

PCT Pub. Date: May 16, 2002

(65) Prior Publication Data

US 2002/0193988 A1 Dec. 19, 2002

(30) Foreign Application Priority Data

Nov. 9, 2000 (EP) ..... 002039378

(51) Int. Cl.
*G10L 21/00* (2006.01)

(52) U.S. Cl. ..... 704/205

(58) Field of Classification Search ..... None
See application file for complete search history.

(56) References Cited

U.S. PATENT DOCUMENTS 6,704,711 B2 * 3/2004 Gustafsson et al. ..... 704/258

OTHER PUBLICATIONS

Miet et al, "Low-Band Extension of Telephone Band Speech," 2000 IEEE International Conference on Acoustics, Speech, and Signal Processing, pp. 1851-1854, vol. 3.*

J. Epps et al; "A New Technique for Wideband Enhancement of Coded Narrowband Speech", IEEE Workshop on Speech Coding Proceedings, Mode, Coders and Error Criteria, XX, XX, Jun. 20, 1999, pp. 174-176, XP002159073.

G. Miet et al; "Low-Band Extension of Telephone-Band Speech", 2000 IEEE International Conference on Acoustics, Speech, and Signal Processing. Proceedings (Cat. No. 00CH37100), Proceedings of 2000 International Conference on Acoustics, Speech and Signal Processing, Istanbul, Turkey, Jun. 5-9, 2000, pp. 1851-1854, vol. 3, XP002189055.

S. Chennoukh et al; "Speech Enhancement Via Frequency Bandwidth Extension Using Line Spectral Frequencies", 2001 IEEE International Conference on Acoustics, (Cat. No. 01CH37221), 2001 IEEE International Conference on Acoustics, Speech, and Signal Processing. Proceedings, Salt Lake City, UT, USA, May 7-11, 2001. pp. 665-668, vol. 1, XP002189056.

* cited by examiner

*Primary Examiner*—Angela Armstrong

(57) ABSTRACT

Wideband extension of telephone speech for higher perceptual quality. A method for extending the frequency range of a speech signal using wideband extension method with an inverse filter and a synthesis filter where both filters receive LPC coefficients from an LPC estimator. The wideband LPC coefficients are obtained from wideband LSFs. The wideband LSFs are obtained by appending highband LSFs, created by applying a matrix to narrowband LSFs, and lowband LSFs, created by dividing the narrowband LSFs by two. The matrix used to create the highband LSFs is selected from a predetermined list of matrices. The selection is based on either wideband or narrowband reflection coefficients extracted from the narrowband speech signal.

8 Claims, 2 Drawing Sheets

WIDEBAND EXTENSION OF TELEPHONE SPEECH FOR HIGHER PERCEPTUAL QUALITY

The present invention relates to a method for extending line spectral frequencies of a narrowband speech signal with a frequency range to line spectral frequencies of a wideband speech signal comprising a highband frequency range and the frequency range of the narrowband speech signal and to a system for extending the frequency range of speech signals at an input comprising an output and an upsampler connected to the input of the system and an input analysis means for determining linear prediction coefficients and reflection coefficients, an input of the input analysis means connected to the input of the system, the upsampler comprising an output connected to an input of a first filter, which first filter comprises an output and is arranged to filter based on linear prediction coefficients, the output of the first filter connected to a an input of a spectral folding means with an output connected to an input of a second filter comprising an output, which second filter is arranged to filter based on the linear prediction coefficients, the output of the second filter being connected to the output of the system for extending the frequency range of speech signals Such a method and system is known from the publication 'wideband extension of telephone speech using a hidden Markov model' by Peter Jax and Peter Vary, IEEE Workshop on Speech coding, September 2000, Wisconsin. Here the narrowband input signal is classified into a limited number of speech sounds in which the information about the wideband spectral envelope is taken from a pre-trained code book. For the codebook search algorithm a statistical approach based on a hidden Markov model is used, which takes different features of the bandwidth limited speech into account, and minimizes a mean squared error criterion. The algortihm needs only one single wideband codebook and inherently guarantees the tranparency of the system in the narrowband frequency range. The enhanced speech exhibits a significant larger bandwidth than the input speech. The algortihm creates the entire wideband signal by applying codebook LPC coefficients to a first, inverse, filter that acts on the input signal and then provides the filtered and subsequently spectrally folded signal to a second, synthesis, filter. This synthesis filter also receives codebook LPC coefficients and provides the wideband signal at the output. Because the transfer functions of these two filters are mutually inverse the narrowband signal is processed transparently by the system.

This method of wideband extension has the disadvantage that the filtered signal as provided by the first filter is not sufficiently flat to provide, after spectral folding, an optimal signal for the second filter to create a highband speech signal.

The objective of the present invention is to provide a method of extending a narrowband speech signal to a wideband speech signal where after spectral folding an optimal signal is provided to the inverse filter.

The invention achieves this object by applying the following steps

Deriving line spectral frequencies for the extended frequency range of the wideband speech signal by applying a matrix obtained by training to line spectral frequencies of wideband speech signals in the frequency range of the narrowband speech signal.

Mapping the line spectral frequencies of the narrowband speech signal to line spectral frequencies of the wideband speech signal in the frequency range of the narrowband speech signal Combining the line spectral frequencies for the highband frequency range with the line spectral frequencies of the narrowband speech signal.

This way the LSFs of the narrowband speech signal are mapped directly without processing to the equivalent lowband LSFs of the wideband speech signal, while the highband frequency range of the wideband signal is created by applying a matrix to the LSFs of the narrowband speech signal. Because the mapping of the highband LSFs does not affect the lowband LSFs, an optimally flat signal can be obtained from the first filter. After spectral folding, the spectrum of the folded signal remains flat providing an optimal input signal for the synthesis filter.

One method to obtain the highband LSFs is by applying a matrix obtained by training to line spectral frequencies of wideband speech signals in the frequency range of the narrowband speech signal. Also the use of multiple matrices to further optimize the synthesis of the highband signal is enabled by the independent processing.

The line spectral frequencies are obtained by decomposition of the impulse response of the LPC analysis filter into even and odd functions. In this extension technique LSFs are estimated from the input narrowband signal. The LSFs are located between 0-$\pi$ in 4 kHz bandwidth of a narrowband speech signal sampled at 8 kHz. Assuming that the corresponding wideband speech is modelled using an LPC model with twice the order of the narrowband LPC model, the narrowband LSFs should represent the wideband LSFs in the lowband range 0-$\pi/2$. Thus the lowband LSFs of the wideband speech signal are given as the narrowband LSFs divided by 2.

In a simulation of the wideband speech where the synthesis uses lowband LSFs obtained from narrowband speech as described above and the highband LSFs are taken from the corresponding wideband speech very good output quality was obtained.

The high band LSFs can obtained from the lowband LSFs using a matrix. The matrix is obtained by training and needs to be established just once. It is also possible to obtain several matrices, each matrix being specific to the type of signal being processed. Once such a matrix is obtained the wideband LPC coefficients are obtained as follows:

First linear prediction and reflection coefficients of the narrowband speech signal are estimated. Then LSFs are computed from these linear prediction. These LSFs are divided by two and provided directly to an array appender and to the highband LSF estimator. The highband LSF estimator applies a matrix selected from a set of matrices to the divided LSFs. The matrix selection is based on the type of signal that is being processed.

The result of the application of the selected matrix to the divided LSFs is a set of highband LSFs. These highband LSFs are then provided to the array appender. The array appender appends the highband LSFs to the lowband LSFs to form the wideband LSFs. The resulting array of wideband LSFs allows the calculation of the wideband LPCs which are used in the synthesis of the wideband speech signal in a system such as disclosed by Jax. LSFs and LPC coefficients form the basis of various methods and systems for extending the frequency range of a speech signal that improve the perceived quality of said speech system. There fore the extension of narrowband LSFs and LPC coefficients to wideband LSFs and LPC coefficients as provided by the present invention can be used in other systems for extending the frequency range of a speech signal as well.

The extension of the frequency range of speech signals is used in receiving terminals in systems where channel resources are to be conserved and speech is transmitted with a narrow bandwidth. Examples of the systems include mobile phones, video conferencing terminals and internet telephony terminals.

The present invention will now be described based on figures.

Figure 1:
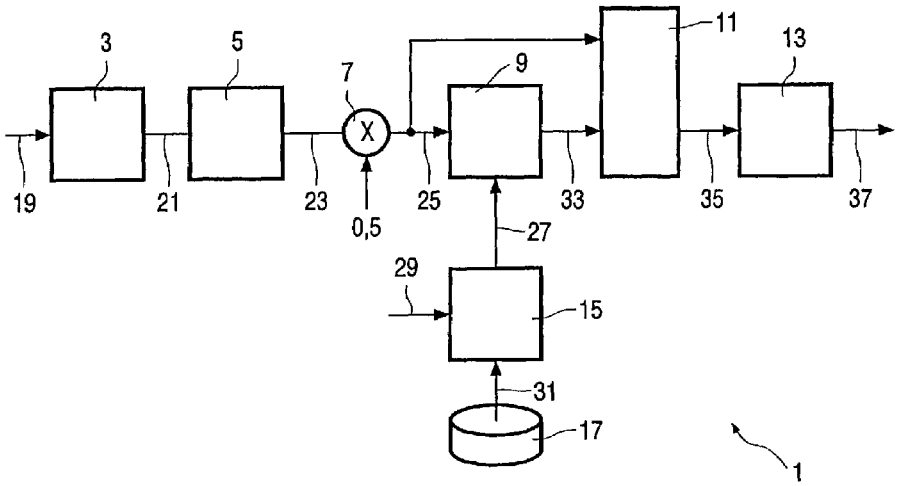
FIG. 1 shows a speech decoder according to the present invention

FIG. 1 shows the section of the system for frequency extension where the wideband LSFs are determined. This section of the system receives a narrowband speech signal via the input 19 of input analysis means 3. Based on this narrowband speech signal the linear prediction and reflection coefficients are determined by the input analysis means 3. The input analysis means 3 provides these linear prediction coefficients via connection 21 to the line spectral frequency estimator 5. The line spectral frequency estimator provides line spectral frequencies LSFs to a multiplier 7 where the LSFs are divided by 2 by multiplying by 0.5. The multiplier provides on it's output divided LSFs. These divided LSFs are provided to both the array appender 11 and the highband LSF estimator 9. The highband LSF estimator 9 estimates the highband LSFs by applying a matrix to the divided LSFs as received from the multiplier 7. In order to determine which matrix to use a matrix selector 15 receives information via the input 29 about the received narrowband speech signal and selects a matrix from the list of matrices 17. The information the matrix selector receives about the received narrowband speech signal are the reflection coefficients k1, k2. The input analysis means obtains these reflection coefficients k1 and k2 at the same time as it determines the LPC coefficients. The reflection coefficients k1 and k2 are thus based on the narrowband speech signal. The highband LSF estimator 9 provides the estimated highband LSFs to the array appender 11 where the highband LSFs are appended to the lowband LSFs. When the narrowband, i.e. lowband, LSFs and highband LSFs are appended the resulting LSFs are wideband LSFs. These wideband LSFs are provided by the array appender 11 to a linear prediction determinator 13 where wideband LPC coefficients are determined using a standard method in the field of speech coding. These wideband LPC coefficients are then provided on the output 37 to be used in the ordinary fashion to create a wideband speech signal through synthesis with an inverse filter, a synthesis filter and spectral folding as explained in FIG. 4.

The first two reflection coefficients k1, k2 of all the reflection coefficients provided by the input analysis means 3 are used to classify the speech signal by determining to which cluster of reflection coefficients the reflection coefficients k1 and k2 are associated. Based on a search, for instance a bayesian search, by the matrix selector 15 a matrix M is selected from a matrix list 17 of predetermined matrices. These predetermined matrices are obtained by training to line spectral frequencies of wideband speech signals in the frequency range of the narrowband speech signal.

The matrix selector 15 provides either the selected matrix or information indicating which matrix was selected to the highband LSF estimator 9 in FIG. 1. It is of course also possible that the reflection coefficients k1 and k2, or information about which matrix is to be selected is obtained from a speech coder and are transmitted from the speech coder to the speech decoder over a channel connecting the speech coder to the speech decoder. In that case the information could be directly, without computations, be provided to the highband LSF estimator. The exact implementation is further dependent on whether the frequency extension system is part of a decoder and has access to the coded speech data as received by the speech decoder, or is a standalone system processing an narrowband speech signal. In case it is a stand alone system all parameters required, i.e. LPCs, LSFs, k1, k2, must be determined by the system itself. In case the system is part of a speech decoder the parameters might be obtained directly from the decoder or be comprised in the received coded speech signal.

Figure 2:
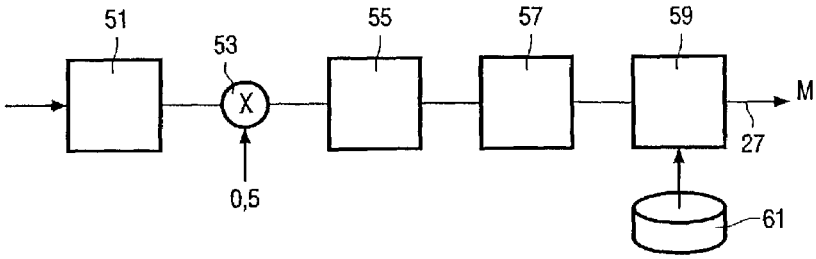
FIG. 2 shows a system for determining the classification of reflection coefficients obtained from wideband LPC coefficients.

FIG. 2 shows a system for determining the reflection coefficient clusters k1 and k2 based on wideband LPC coefficients. The narrow band speech LPC coefficients as obtained by input analysis means 3 in FIG. 1 are provided to a line spectral frequency estimator 51. The resulting LSFs are divided by two by multiplying the LSFS by 0.5 by multiplier 53. The resulting LSFs are thus wideband LSFs. Based on these divided LSFs wideband linear prediction coefficients are computed by the LPC estimator 55. The LPC coefficients are used by the reflection coefficient estimator 57 to compute the wideband reflection coefficients. The first two reflection coefficients k1, k2 of all the reflection coefficients provided by the reflection coefficient estimator 57 are used to classify the speech signal. Based on a search, for instance a Bayesian search, by the matrix selector 59 a matrix M is selected from a matrix list 61 of predetermined matrices. These predetermined matrices are obtained by training to line spectral frequencies of wideband speech signals in the frequency range of the narrowband speech signal.

The matrix selector 59 provides either the selected matrix or information indicating which matrix was selected to the highband LSF estimator 9 in FIG. 1. It is of course also possible that the wideband reflection coefficients k1 and k2, or information about which matrix is to be selected is obtained from the speech coder and would be transmitted from the speech coder to the speech decoder over a channel connecting the speech coder to the speech decoder. In that case the information could be directly, without computations, be provided to the highband LSF estimator. The exact implementation is further dependent on whether the frequency extension system is part of a decoder and has access to the coded speech data as received by the speech decoder, or is a standalone system processing an narrowband speech signal. In case it is a stand alone system all parameters required, i.e. LPCs, LSFs, k1, k2, must be determined by the system itself. In case the system is part of a speech decoder the parameters might be obtained directly from the decoder or be comprised in the received coded speech signal.

Figure 3:
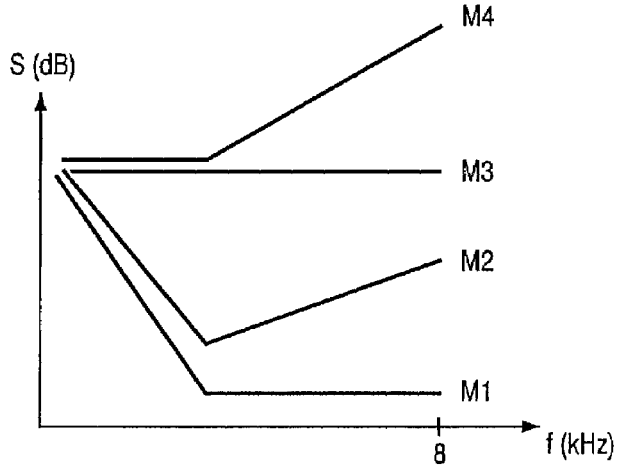
FIG. 3 shows the amplitude spectral envelope shape corresponding to the reflection coefficient clusters (k1, k2).

FIG. 3 shows the amplitude spectral envelope shape corresponding to reflection coefficient clusters k1 and k2. There is a limited set of shapes of the amplitude spectral envelope where each shape differs from the other in order to allow the modelling of the highband speech signal. Each shape corresponds to a particular matrix (M1, M2, M3, M4)

which in turn corresponds to a particular reflection coefficient cluster k1 and k2, and the matrix is selected based on the reflection coefficients k1 and k2.

Figure 4:
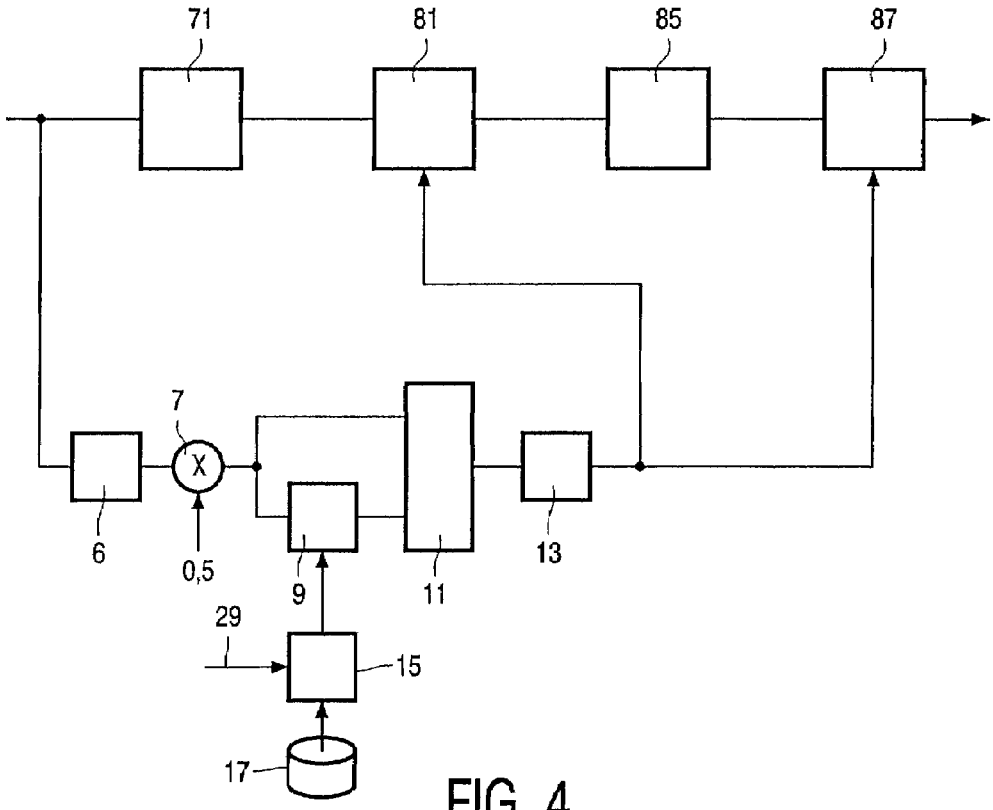
FIG. 4 shows the complete system for extension of the frequency range of a speech signal.

FIG. 4 shows the complete system for extending the frequency range of a speech signal.

The system for extending the frequency range of a speech signal of FIG. 4 receives a narrowband speech signal on the input and provides the signal to an upsampler 71, and an input analysis means 6. The input analysis means 6 corresponds to the combination of the input analysis means 3 and LSF determinator 5 in FIG. 1. The section from the input analysis means 6 to the wideband LPC estimator 13 corresponds tot subsystem shown in FIG. 1. The determination of the matrix that is to be used by the highband LSF estimator 9 in FIG. 4 is achieved in the same fashion as described in FIG. 1 or FIG. 2. FIG. 4 includes the embodiment of FIG. 1. Corresponding elements in FIG. 1 and FIG. 4 have the same reference numerals.

The upsampler 71 provides an upsampled signal to the first filter 81. The first filter 81 then filters this upsampled signal where the filter uses the wideband LPC parameters as provided by the linear prediction determinator 13. The wideband LPC parameters are obtained in the same fashion as described in FIG. 1.

The first, inverse, filter provides a filtered signal to the spectral folding means 85 where the frequency range of the filtered signal is extended by spectral folding. Since the filtered and spectrally folded signal is used by the synthesis filter 87 to create the wideband output signal using the wideband LPC coefficients it is important that the filtered signal at the output of the inverse filter is spectrally flat in order to ensure that after spectral folding the highband portion of the filtered signal remains spectrally flat before being filtered by the synthesis filter 87. By providing the lowband LSFs, after multiplying by 0.5, directly to the inverse filter 81 an optimal signal can be provided to the synthesis filter 87, resulting in an optimal highband signal in the wideband signal. The synthesis filter 87 filters the filtered and spectrally folded signal using the same LPC coefficients as the first filter and provides an output signal with an extended frequency range at the output of the system.

The invention claimed is:

1. A method for extending line spectral frequencies of a narrowband speech signal with a frequency range to line spectral frequencies of a wideband speech signal comprising a highband frequency range and the frequency range of the narrowband speech signal, the method comprising:

Deriving line spectral frequencies for the highband frequency range of the wideband speech signal by applying a matrix obtained by training to line spectral frequencies of wideband speech signals in the frequency range of the narrowband speech signal, to the line spectral frequencies of the narrowband speech signal;

Mapping the line spectral frequencies of the narrowband speech signal to line spectral frequencies of the wideband speech signal in the frequency range of the narrowband speech signal;

Combining the line spectral frequencies for the highband frequency range with the line spectral frequencies of the narrowband speech signal to yield a combined signal, wherein the matrix is selected from a list of predetermined matrices based on reflection coefficients obtained from wideband linear prediction coefficients; and synthesizing speech using said combined signal.

2. A method for extending line spectral frequencies of a narrowband speech signal according to claim 1, characterized in that the matrix is selected from, a list of predetermined matrices based on reflection coefficients obtained from the narrowband speech signal.

3. A system for extending the frequency range of speech signals at an input comprising an output and an upsampler connected to the input of the system and an input analysis means for determining linear prediction coefficients and reflection coefficients, an input of the input analysis means connected to the input of the system, the upsampler comprising an output connected to an input of a first filter, wherein the first filter comprises an output and is arranged to filter based on lincar prediction coefficients, the output of the first filter connected to an input of a spectral folding means, the spectral folding means having an output connected to an input of a second filter comprising an output, wherein the second filter is arranged to filter based on the linear prediction coefficients, the output of the second filter being connected to the output of the system for extending the frequency range of speech signals, further comprising: an output of the input analysis means, wherein the input analysis means is operative to provide line spectral frequencies of the speech signals inputted to the input analysis means, and is connected to an input of a multiplier, wherein the multiplier is operative to multiply the line spectral frequencies of the speech signals by 0.5 and provide the line spectral frequencies multiplied by 0.5 to an array appender and to a highband LSF estimator, where the array appender is operative to append highband LSFs as provided by the highband LSF estimator to the line spectral frequencies multiplied by 0.5, the array appender comprising an output connected to an input of a linear prediction coefficient determinator comprising an output for providing linear prediction coefficients to the first filter and the second filter.

4. A system for extending the frequency range of speech signals according to claim 3, wherein the highband LSF estimator is arranged to determines the highband LSFs by applying a matrix to the line spectral frequencies multiplied by 0.5.

5. A system for extending the frequency range of speech signals according to claim 4, wherein the system is operative to select the matrix from a predetermined list of matrices.

6. A system for extending the frequency range of speech signals according to claim 5, wherein the system is operative to select the matrix based on reflection coefficients obtained from the narrowband speech signal.

7. A system for extending the frequency range of speech signals according to claim 6, wherein the system is operative to select the matrix based on reflection coefficients obtained from wideband LPC coefficients.

8. A mobile telephone comprising a system for extending the frequency range of speech signals according to claim 3.

* * * * *